United States Patent [19]

Llewellyn

[11] Patent Number: 4,981,110

[45] Date of Patent: Jan. 1, 1991

[54] BABY WALKER ORGANIZATION

[76] Inventor: Giannina Llewellyn, 2960 E. Jackson Ave. #93, Anaheim, Calif. 92806

[21] Appl. No.: 439,148

[22] Filed: Nov. 20, 1989

[51] Int. Cl.[5] ..... A61G 1/00; A01K 29/00

[52] U.S. Cl. ..... 119/96; 272/70; 224/160; 224/264

[58] Field of Search ..... 119/96; 224/158, 159, 224/160, 161, 264; 272/70, 70.3, 70.4; 128/874, 875

[56] References Cited

U.S. PATENT DOCUMENTS

| | | | |
|---|---|---|---|
| 1,605,473 | 11/1926 | Schneidau | 224/159 |
| 1,749,999 | 3/1930 | Crocker | 119/96 |
| 4,840,144 | 6/1989 | Voorhees et al. | 119/96 |
| 4,877,238 | 10/1989 | Barrett | 272/70 |

FOREIGN PATENT DOCUMENTS

| | | | |
|---|---|---|---|
| 863713 | 1/1941 | France | 224/160 |
| 948829 | 6/1947 | France | 224/264 |
| 219874 | 8/1924 | United Kingdom | 224/264 |

*Primary Examiner*—John Weiss
*Attorney, Agent, or Firm*—Leon Gilden

[57] ABSTRACT

A baby walker organization is set forth comprising a one-piece harness to overlie a child's torso with a front panel and back panel interconnected by a bottom web with leg apertures positioned to either side of the bottom web. Shoulder straps are integrally formed to the front and back panels defining arm openings aligned relative to one another through side portions of the organization. A first embodiment includes a flexible fabric material with elongate straps extending beyond the shoulder straps from grasping by an adult to assist in the walking of a young child. A further embodiment includes a one-piece tosros unit formed of semi-rigid material, preferably polymeric, with strap members extending beyond the torso member formed with forward terminal ends secured to forward portions of the torso, with rear terminal ends selectively securable to a rear portion of the torso utilizing cord members, wherein the cord members are removed to enable the further ends of the elongate straps to be reversed relative to the rear panel of the torso unit for use of the unit as a backpack. Furthermore, flexible pneumatic cylinders formed with a through-extending axial opening are provided for use as grasp handles in the first embodiment and for use as shoulder pad members in a second embodiment.

1 Claim, 4 Drawing Sheets

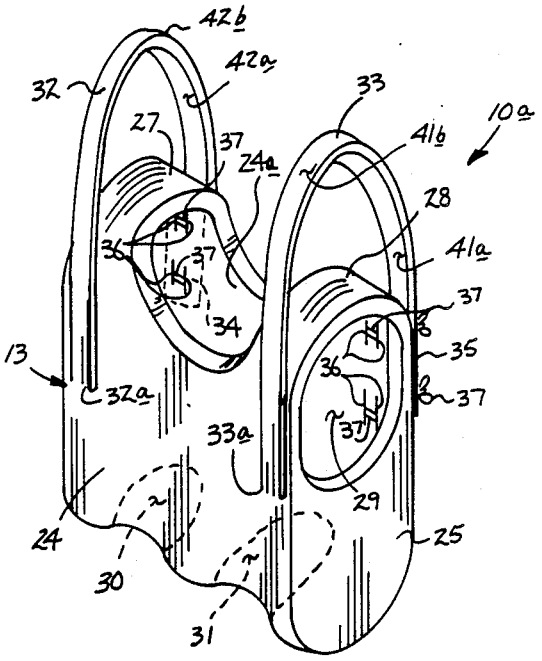
FIG 6
FIG 7
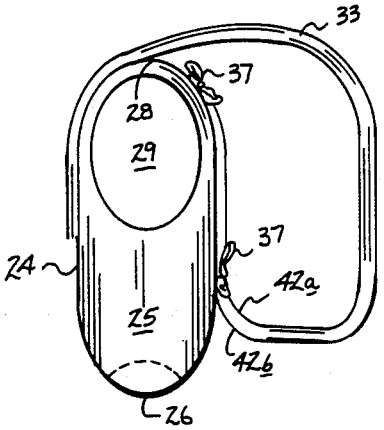

BABY WALKER ORGANIZATION

BACKGROUND OF THE INVENTION

1. Field of the Invention

The field of invention relates to trainer organizations, and more particularly pertains to a new and improved baby walker organization wherein the same may be utilized in a first orientation to assist a child in learning to walk and repositionable for use as a backpack.

2. Description of the Prior Art

The use of various training devices to assist a young child, and particularly an infant, in the walking procedure have been heretofore developed in the prior art. Prior art devices, however, have failed to provide a multi-purpose device to accommodate infants of a predetermined age group that are in the process of learning to walk by enabling a walking procedure to take place and thereafter enable convenient transport of the individual child. Examples of prior art include U.S. Pat. No. 1,749,999 to Crocker wherein a child's walking device is provided with an individual elongate split gap between a rear panel of the device to afford minimal accommodation of a child's configuration, as opposed to the instant invention utilizing split seams formed in the side panels to more readily accommodate that child's proportions.

U.S. Pat. No. 2,108,566 to Sanders sets forth a controlled baby walker wherein a rigid rod is mounted to a strap truss arrangement to assist a child in walking, but the device of the Sander's patent does not utlilize any bottom support to support the child in a walking procedure.

U.S. Pat. No. 1,642,184 to Urso sets forth a crib with an overlying beam wherein a downwardly positioned truss comprising a single belt is securable about the child to assist in a walking-training arrangement.

U.S. Pat. No. 3,721,437 to Skaricic sets forth a training device wherein a boom mounts a strap arrangement for supporting a child with a spring mount shock arrangement to counterbalance and suspend the child in walking.

U.S. Pat. No. 1,193,374 to Gilliam sets forth a baby walker utilizing a strap arrangement to support a cross-strap arrangement mounted about the child's torso, but failing to provide underlying support neccesary in the support of infants in a walking procedure.

As such, it may be appreciated that there is a continuing need for a new and improved baby walker organization which addresses both the problems of ease of use, as well as well as effectiveness in construction and as such, the instant invention substantially fulfills this need.

SUMMARY OF THE INVENTION

In view of the foregoing disadvantages inherent in the known types of baby walkers now present in the prior art, the present invention provides a baby walker organization wherein the same utilizes a torso surrounding truss for support of a child in a walking procedure. As such, the general purpose of the present invention, which will be described subsequently in greater detail, is to provide a new and improved baby walker organization which has all the advantages of the prior art baby walkers and none of the disadvantages.

To attain this, the present invention comprises a baby walker organization with a one-piece harness to overlie a child's torso with a front panel and back panel interconnected by a bottom web with leg apertures positioned to either side of the bottom web. Shoulder straps are integrally formed to the front and back panels defining arm openings aligned relative to one another through side portions of the organization. A first embodiment includes a flexible fabric material with elongate straps extending beyond the shoulder straps for grasping by an adult to assist in the walking of a young child. A further embodiment includes a one-piece torso unit formed of semi-rigid material, preferably polymeric, with strap members extending beyond the torso member formed with forward terminal ends secured to forward portions of the torso, with rear terminal ends selectively securable to a rear portion of the torso utilizing cord members, wherein the cord members are removed to enable the further ends of the elongated straps to be reversed relative to the rear panel of the torso unit for use of the unit as a backpack. Futhermore, flexible pneumatic cylinders formed with a through-extending axial opening are provided for use as grasp handles in the first embodiment and for use as shoulder pad members in a second embodiment.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baby walker organization which has all the advantages of the prior art baby walkers and none of the disadvantages.

It is another object of the present invention to provide a new and improved baby walker organization which may be easily and efficiently manufactured and marketed.

It is further object of the present invention to provide a new and improved baby walker organization which is of a durable and reliable construction.

An even further object of the present invention is to provide a new and improved baby walker organization which is susceptible of a low cost of manufacture with regard to both materials and labor, and which accordingly is then susceptible of low prices of sale to the consuming public, thereby making such baby walker organizations economically available to the buying public.

Still yet another object of the present invention is to provide a new and improved baby walker organization which provides in the apparatuses and methods of the prior art some of the advantages thereof, while simultaneously overcoming some of the disadvantages normally associated therewith.

Still another object of the present invention is to provide a new and improved baby walker organization wherein the same provides a torso surrounding support for a child and further enabling conversion of the device to a backpack.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description therefore. Such description makes reference to the annexed drawings wherein:

FIG. 6 is an isometric illustration of a further embodiment of the instant invention.

FIG. 7 is a side orthographic view taken in elevation of the further embodiment of the instant invention.

DESCRIPTION OF THE PREFERRED EMBODIMENT

Figure 1:
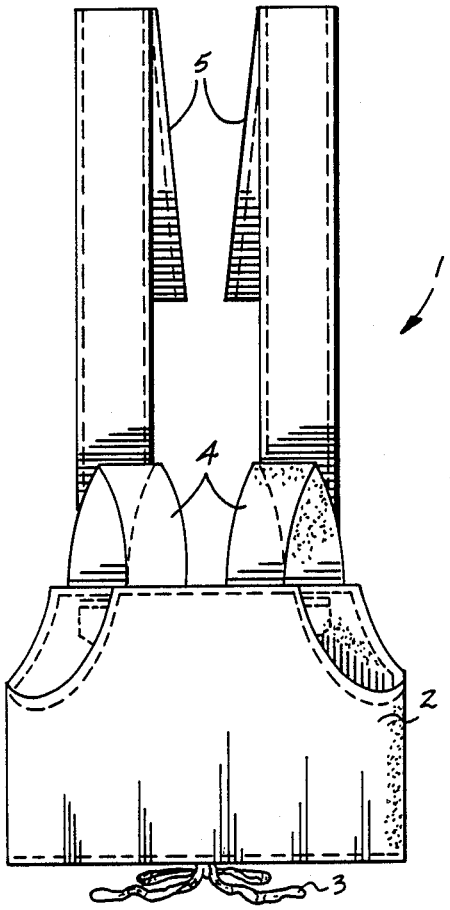
Fig 1 PRIOR ART
FIG. 1 is an isometric illustration of a prior art baby walker device.

With reference now to the drawings, and in particular to FIGS. 1 to 10 thereof, a new and improved baby walker organization embodying the principles and concepts of the present invention and generally designated by the reference numerals 10 and 10*a* will be described.

More specifically, the baby walker organization 10 sets forth an improvement over the prior art device illustrated in FIG. 1 wherein the prior art baby walker 1 utilizes a surrounding truss formed with a laced rear slit that includes a cord 3 to secure the rear slit with shoulder straps 4 and upwardly extending strap members 5 of a fixed length for support by an adult.

Figure 2:
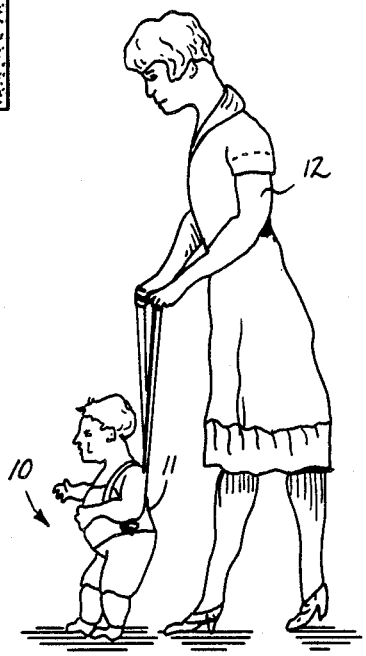
FIG. 2 is an isometric illustration of the baby walker of the instant invention secured to a child.

FIG. 2 illustrates the baby walker organization 10 in securement about a child 11 and manipulated by an adult 12. The baby walker 10 (with reference to FIGS. 3–5) includes a body harness defined by a forward panel 13 spaced forwardly of a rear panel 13*a*, each of a mirror image relative to one another with a first support loop 14 and a second support loop 15 secured at their lowermost ends to overlie respective first and second shoulder straps 19 and 20 extend thereabove. The first and second support loops 14 and 15 are of a flexible material to enable guidance and suspension of a child positioned within the body harness. The body harness should be noted to encompass the torso of the child in use. The harness further includes a bottom web 16 joining the forward and rear panels 13 and 13*a* together with a first and second leg aperture 17 and 18 respectively directed through the bottom web 16 in alignment with the respective shoulder straps 20 and 19. The forward and rear panels include side slots 21 positioned medially and underlying respective shoulder straps 19 and 20 with a plurality of side lace cords 22 to secure opposed side edges defining the side slots 21 to acommodate adjustment of children of various configurations within the body harness.

Figure 8:
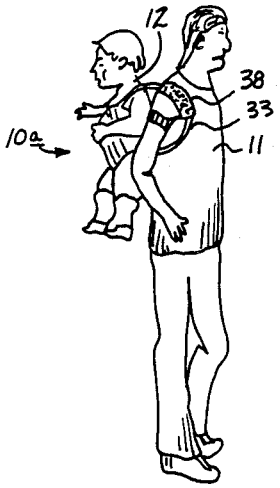
FIG. 8 is an isometric illustration of the further embodiment of the instant invention illustrated for use as a backpack.

Attention to FIGS. 6 and 7 illustrate a modified organization 10*a* including a one-piece body harness 23 formed of a semi-rigid material to enable positioning of a child therethrough wherein the harness is defined by forward side 24 defining a mirror image of a rear side 24*a* with side panels 25 spaced parallel relative to one another and orthogonally oriented relative to the forward and rear sides 24 and 24*a*, with a solid arcuate bottom web 26 and right and left shoulder webs 27 and 28 respectively overlying right and left leg openings 30 and 31. The side panels 25 include right and left arm openings 29 of a generally elliptical configuration in coaxial alignment relative to one another between the parallel spaced side panels 25. Right and left shoulder webs 27 and 28 overlie the leg openings 30 and 31 respectively to properly align the leg openings relative to the torso portion of the harness. Right and left flexible should belts 32 and 33 are secured to opposed sides, i.e. forward side 24 and rear side 24*a*, with respective right and left forward terminal ends 32*a* and 33*a* integrally mounted and extending medially of the forward side 24 utilizing seaming or adhesive securement of the right and left terminal ends to the forward side. The flexible shoulder belts 32 and 33 further include right and left rearend portions 34 and 35 that overlie upper and lower aligned pairs of slits 36. The slits accommodate securement tie cords 37 that are directed through the slits and through the rearend portions 34 and 35 to secure the shoulder belts 32 and 33 to the harness 23. The flexible shoulder belts 32 and 33 further include respectively a left interior surface 41*a* and a left exterior surface 41*b* defining the opposed surfaces of the shoulder belt 33 with the right shoulder belt 32 defined by a right interior surface 42*a* and right exterior surface 42*b*. In use, the respective interior surfaces 42*a* and 41*a* are initially secured to the rear side 24*a* of the harness. When desired to use the harness as a backpack with a child mounted interiorly therewithin, as illustrated in FIG. 8, the respective exterior surfaces, i.e. the left exterior surface 41*b* and the right exterior surface 42*b*, are secured to the rear side 24*a*, as illustrated in FIG. 7.

Figure 3:
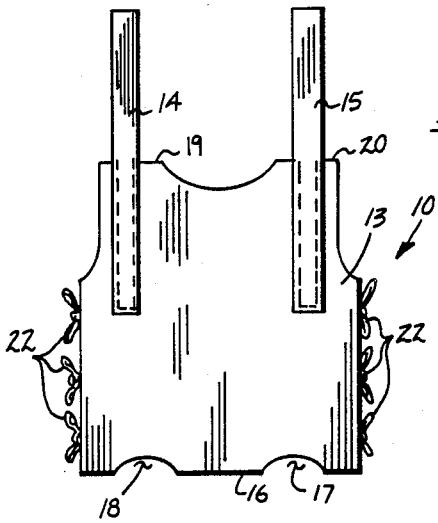
FIG. 3 is a front orthographic view taken in elevation of the instant invention.
Figure 4:
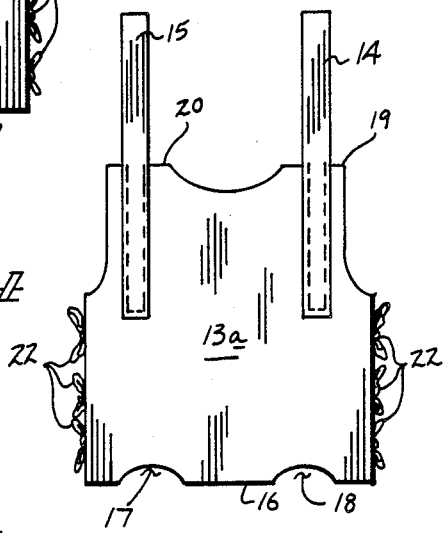
FIG. 4 is a rear orthograpic view taken in elevation of the instant invention.
Figure 5:
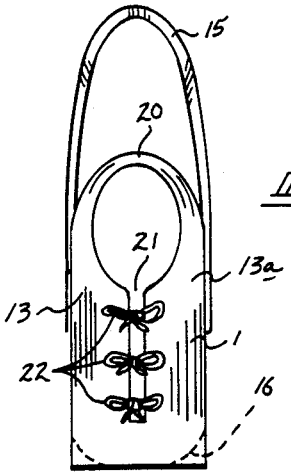
FIG. 5 is a side orthographic view taken in elevation of the instant invention.
Figure 9:
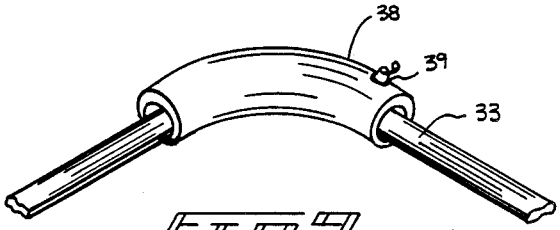
FIG. 9 is an isometric illustration of a pneumatic tube for use with the instant invention.
Figure 10:
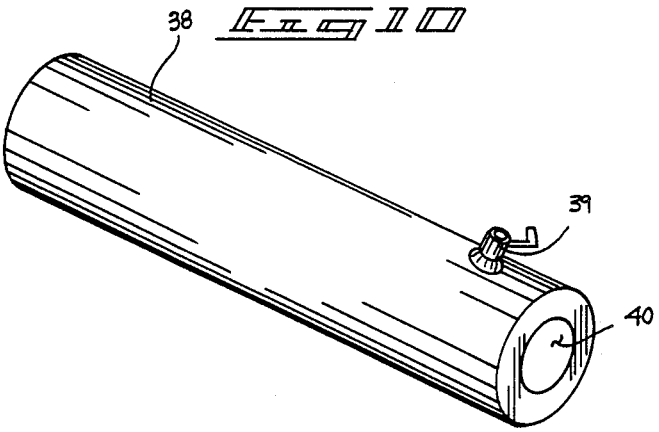
FIG. 10 is an isometric illustration of the pneumatic tube for use with the instant invention.

FIGS. 9 and 10 illustrate the use of an inflatable pneumatic tube 38 that is utilized as an inflatable grip that is slid along a respective shoulder belt 32 or 33 in the embodiment of FIGS. 6 and 7, or along the support loops 14 and 15 of FIG. 3, wherein the pneumatic tubes each include an inflation valve 39 with a central through-extending opening 40 to receive the respective belts or loops therethrough. In use as a backpack, the pneumatic tube serves as a shoulder pad to enhance the ease of use of the device.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A baby walker organization comprising, a single torso encompassing harness that includes a foward panel spaced from a rear panel, and a bottom web including spaced first and second leg aperture directed through the bottom web, and first and second spaced shoulder straps spaced above and overlying the respective first and second leg openings, wherein the first and second shoulder straps connect the forward and rear panels, and first and second elongate shoulder belts each including forward and rear end portions respectively secured to the forward and rear panels, and wherein the forward and rear panels each define right and left side panels, the right and left side panels each include an arm opening, the arm openings aligned relative to one another, and wherein the right and left side panels each include a slot directed from each arm opening downwardly therefrom, and the slots each include spaced edges, the spaced edges adjustably secured together, and a plurality of lace cords wherein the cords adjustably secure side edges together, and further including spaced parallel side panels, the side panels each include axially aligned elliptical arm openings, and wherein the forward ends of each first and second elongate shoulder belt are fixedly mounted to the forward panel, and the rear end portions of the first and second elongate shoulder belts are selectively securable to the rear panel, and wherein the rear panels each include plural pairs of slots, the slots aligned with the rear end portion of the elongate shoulder belt, and further including plural pairs of tie cords, the tie cords directed and received through the rear end portions of the elongate shoulder belts and through the plural pairs of slots to selectively secure the rear end portions of the shoulder belts to the rear panel to enable selective securement of an interior surface or an exterior surface defined by each rear end portion to the rear panel, and further including a flexible, pneumatic tube defining a pneumatic chamber in surrounding and sliding relationship relative to each elongate shoulder belt, each pneumatic tube including a valve for selective inflation of the tube, and each tube further including a central through-extending opening to respectively receive a respective first or second shoulder belt through a respective pneumatic tube, and each pneumatic tube defined by a predetermined length less than a length defined by each elongate shoulder belt.

* * * * *